US005678619A

United States Patent [19]

Brand

[11] Patent Number: 5,678,619

[45] Date of Patent: Oct. 21, 1997

[54] METHOD AND APPARATUS FOR CUTTING VENEER FROM A TAPERED FLITCH

[75] Inventor: Robert D. Brand, Lawrence, Ind.

[73] Assignee: Capital Machine Co., Inc., Indianapolis, Ind.

[21] Appl. No.: 564,948

[22] Filed: Nov. 30, 1995

Related U.S. Application Data

[63] Continuation of Ser. No. 455,479, May 31, 1995, Pat. No. 5,562,137, and Ser. No. 454,960, May 31, 1995.

[51] Int. Cl.[6] ..... B27C 1/00; B27L 5/02

[52] U.S. Cl. ..... 144/363; 144/209.1; 144/215.3; 144/365; 144/177; 269/47; 269/50

[58] Field of Search ..... 269/47, 50, 51, 269/52; 144/162 R, 177, 178, 209.1, 213, 215.3, 212, 363, 365, 369

[56] References Cited

U.S. PATENT DOCUMENTS

| | | | |
|---|---|---|---|
| 144,938 | 11/1873 | Williams | 144/177 |
| 793,306 | 6/1905 | Koss . | |
| 2,576,520 | 11/1951 | Koss | 144/278 |
| 2,676,627 | 4/1954 | McFall | 144/178 |
| 2,739,627 | 3/1956 | Vöhringer | 144/177 |
| 3,441,069 | 4/1969 | Koss | 144/369 |
| 3,654,973 | 4/1972 | Koss | 144/178 |
| 3,680,612 | 8/1972 | Hale | 144/178 |
| 3,808,925 | 5/1974 | Hards | 83/346 |
| 3,905,408 | 9/1975 | Hale | 144/178 |
| 4,068,693 | 1/1978 | Cremona | 144/178 |
| 4,069,850 | 1/1978 | Cremona | 144/178 |
| 4,313,481 | 2/1982 | Cremona | 144/177 |
| 4,392,519 | 7/1983 | Calvert | 144/212 |
| 4,503,896 | 3/1985 | Brand | 144/369 |
| 4,587,616 | 5/1986 | Weil | 364/475 |
| 4,601,317 | 7/1986 | Brand | 144/178 |
| 4,683,926 | 8/1987 | Weil | 144/178 |
| 5,101,874 | 4/1992 | Weil | 144/177 |
| 5,143,129 | 9/1992 | Toivio | 144/211 |
| 5,150,746 | 9/1992 | Weil | 144/177 |
| 5,333,658 | 8/1994 | Albion et al. | 144/213 |
| 5,385,184 | 1/1995 | Mellor | 144/178 |

FOREIGN PATENT DOCUMENTS

0627285A2 12/1991 European Pat. Off. .

OTHER PUBLICATIONS

*Double Dogging Flitch System*, Sales Brochure of Capital Machine Co., Inc.

*Primary Examiner*—W. Donald Bray
*Attorney, Agent, or Firm*—Brinks Hofer Gilson & Lione

[57] ABSTRACT

The present invention includes a method and apparatus for cutting veneer from a tapered flitch so as to minimize the amount of waste veneer taken from the outside, or veneer-producing zone, of a flitch. A flitch is mounted to a staylog and oriented so that the veneer-producing zone is parallel to the veneer-slicing knife and the staylog is rotated to move the flitch past the veneer-slicing knife. In some embodiments, the flitch is mounted to the staylog so that the flitch mounting surface is in a non-parallel relation to the staylog mounting surface. In alternative embodiments, the flitch mounting surface is positioned adjacent the staylog mounting surface, and the staylog, or just the staylog mounting surface, is oriented to position the veneer-producing zone in a parallel relation with the veneer-slicing knife.

38 Claims, 10 Drawing Sheets

METHOD AND APPARATUS FOR CUTTING VENEER FROM A TAPERED FLITCH

This is a continuation in part of U.S. patent application Ser. No. 08/455,479 filed May 31, 1995, now U.S. Pat. No. 5,562,137, and of U.S. patent application Ser. No. 08/454,960 filed May 31, 1995.

FIELD OF THE INVENTION

The present invention relates to a method and apparatus for cutting veneer from a tapered flitch, and particularly to cutting veneer so as to minimize the amount of waste veneer taken from the outside, or veneer-producing zone, of a log. More particularly, the invention relates to a method and apparatus for mounting the flitch on the staylog of a rotary veneer slicer so that the axis of rotation of the veneer-producing zone is parallel to the veneer-slicing knife.

BACKGROUND OF THE INVENTION

Staylogs for use with rotary veneer slicers are known. Such staylogs hold a flitch and rotate relative to a slicing knife. As the flitch passes the knife, the knife slices a sheet of veneer from the flitch.

The veneer slicers use a plurality of dogs to hold the flitch in position against a mounting surface on the staylog. The dogs are clamping members that extend from the mounting surface of the staylog and are positioned on either side of the flitch along the length of the staylog. Typically, the dogs include a sharp-edged portion oriented parallel to the mounting surface of the staylog to cut into the flitch and hold it in place against the staylog. The dogs are moved toward each other to pinch the flitch therebetween.

An alternative dogging arrangement is disclosed in U.S. Pat. No. 5,150,746 to Weil. Weil discloses a plurality of oval-shaped rotating dogs that include a sharp-edged portion at the ends of the major axis of the oval. The dogs are arranged in parallel rows along the mounting surface of the staylog. A plurality of axially extending grooves are cut into the mounting surface of the flitch. The grooves are cut to align with the rows of dogs and are sized to allow the dogs to fit up into the grooves when the major axis of the oval is aligned with the groove. When the flitch is mounted on the staylog, the oval-shaped dogs extend upwardly into the grooves and are rotated to engage the sharp-edged portion of the dogs with the flitch.

Regardless of whether clamping dogs or rotating dogs are used, conventional flitch mounting techniques require that the flitch mounting surface be positioned adjacent the staylog mounting surface. Unfortunately, the conventional mounting techniques cause some of the best veneer on a log to be wasted.

A flitch is formed by cutting a log down the middle along its longitudinal axis so that the plane formed by the cut defines a flitch mounting surface and the periphery of the log defines a veneer-producing surface. Conventionally, the mounting surface of the flitch is positioned adjacent the mounting surface of the staylog and the veneer-producing outer portion of the log is positioned to be sliced into sheets of veneer by the knife. However, because the tree trunk is naturally tapered, one end of the flitch is thicker than the other end, and consequently extends a greater distance from the mounting surface of the staylog. As a result, the veneer-producing zone of the flitch is frusto-conical i.e., trapezoidal in cross-section when viewed from the side of the flitch or from the knife.

As the staylog and the flitch are rotated, the knife first encounters the thickest portion of the flitch. With each rotation, the knife slices a wider veneer sheet until the entire length of the flitch is exposed to the knife. Once the entire length of the flitch is being sliced, subsequent sheets are of substantially uniform width. However, the initial sheets, which are cut from the best part of the log, are too narrow to be useful, and are thrown away as wasted product. In addition, with the prior art methods of retention, the long slots formed along the length of the flitch removed sufficient material from the flitch that the flitch lost its rigidity and would flex in response to the pressure of the slicing knife resulting in, at best, nonuniform and unacceptable slices of veneer. Consequently, some of the best veneer on a flitch is thrown away as waste.

Therefore, a need exists for a method and apparatus for mounting a flitch on a staylog in such a manner that the flitch is securely retained on the staylog, that the production of desirable veneer from the outside of the flitch is increased and waste is reduced, and that waste is concentrated in the less desirable, inner portion of the flitch.

SUMMARY OF THE INVENTION

The present invention includes a method and apparatus for cutting veneer from a tapered flitch so as to minimize the amount of waste veneer taken from the outside, or veneer-producing zone, of a flitch. A flitch is mounted to a staylog and oriented so that the veneer-producing zone is parallel to the veneer-slicing knife and the staylog is rotated to move the flitch past the veneer-slicing knife.

In some embodiments, the flitch is mounted to the staylog so that the flitch mounting surface is in a non-parallel relation to the staylog mounting surface. In alternative embodiments, the flitch mounting surface is positioned adjacent the staylog mounting surface, and the staylog, or the staylog mounting surface, is oriented to position the veneer-producing zone in a parallel relation with the veneer-slicing knife.

According to the present invention, the method comprises the steps of positioning the flitch in a veneer-slicing position, the veneer-slicing position being defined so that the veneer-producing zone is generally parallel to a veneer-slicing knife, and rotating the staylog to move the flitch past the veneer-slicing knife. A plurality of pin dog receiving apertures and a plurality of pusher pin receiving apertures are formed in the mounting surface of the flitch, wherein the plurality of pusher pin receiving apertures cooperates with the plurality of pin dog receiving apertures to define a lower boundary of the veneer-producing zone. A plurality of pin dogs and a plurality of pusher pins are coupled to the staylog and inserted into the plurality of pin dog receiving apertures and the plurality of pusher pin receiving apertures, respectively. The pusher pins are moved relative to the pin dogs to move the flitch into engagement with the pin dogs to retain the flitch on the staylog.

In one embodiment of the invention, the flitch mounting surface is positioned against the staylog mounting surface and the staylog mounting surface is oriented at an angle to the axis of rotation of the staylog. The staylog mounting surface is pivotally coupled to the body of the staylog, and the mounting surface is pivoted relative to the body to position the flitch for slicing. The pivoting step includes moving a reorienting means, such as a wedge or roller, between the mounting surface and the body.

In another embodiment of the invention, the flitch mounting surface is positioned against the staylog mounting surface and the staylog is oriented so that the longitudinal axis of the staylog is at an acute angle to the axis of rotation of the staylog.

The invention also includes apparatus for cutting veneer from a flitch. The apparatus includes a staylog having a mounting surface and means for retaining the flitch on the staylog and positioning the veneer-producing zone parallel to the veneer-slicing knife. The retaining means includes a plurality of dogs extending from the staylog mounting surface, each dog including a plurality of engaging surfaces for engaging a flitch at different distances from the mounting surface.

In one embodiment of the invention, the flitch is retained on the staylog by the plurality of dogs so as to orient the flitch mounting surface in a non-parallel relation with the staylog mounting surface.

In alternative embodiments, the flitch is retained on the staylog by the plurality of dogs with the flitch mounting surface disposed adjacent the staylog mounting surface, and the staylog includes means for orienting the veneer-producing zone parallel to the veneer-slicing knife. In one of the alternative embodiments, the orienting means includes means for offsetting the longitudinal axis of the staylog from the axis of rotation of the staylog. In another of the alternative embodiments, the orienting means includes means for setting the plane of the staylog mounting surface at an acute angle to axis of rotation of the staylog. The setting means can include roller or wedges or the like disposed between the staylog mounting surface and the body of the staylog.

Additional features and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

The present invention includes a method and apparatus for cutting veneer from a tapered flitch on a staylog so as to minimize the amount of waste veneer cut from the outside of a log. The method comprises the steps of positioning the flitch in a veneer-slicing position and rotating the staylog to move the flitch past the veneer-slicing knife. A plurality of pin dog receiving apertures and a plurality of pusher pin receiving apertures may be formed in the mounting surface of the flitch. The plurality of pusher pin receiving apertures cooperates with the plurality of staylog engagement surfaces to define a lower boundary of the veneer-producing zone.

A plurality of pin dogs and a plurality of pusher pins can be coupled to the staylog and inserted into the plurality of pin dog receiving apertures and the plurality of pusher pin receiving apertures, respectively, formed in the flitch. The pusher pins are moved relative to the pin dogs to move the flitch into engagement with the pin dogs to retain the flitch on the staylog.

Figure 1:
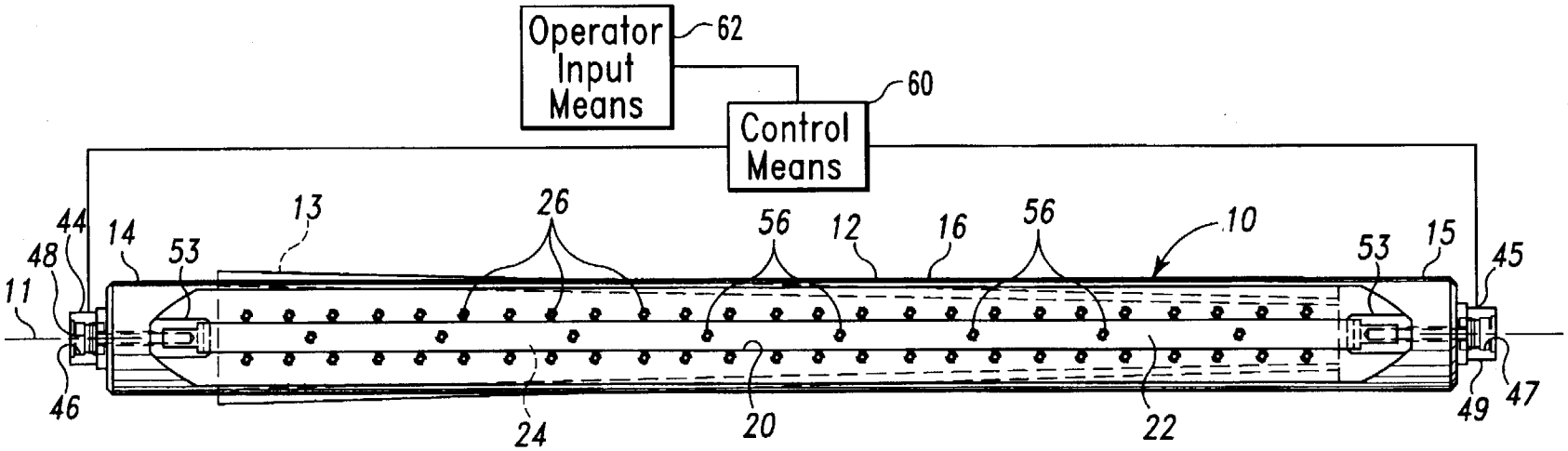
FIG. 1 is a top plan view of a staylog according to the present invention with a flitch (in dotted lines) mounted thereon.
Figure 2:
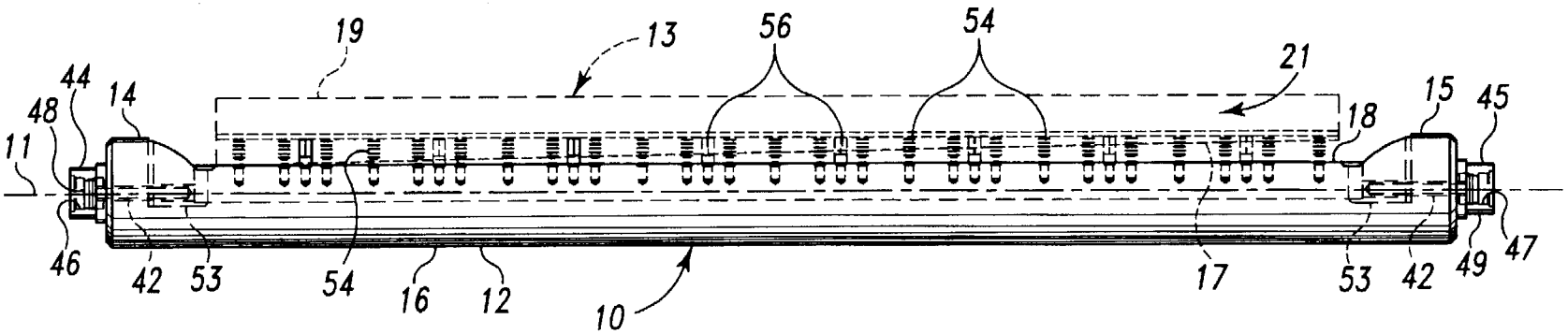
FIG. 2 is a side elevation of the staylog and flitch of FIG. 1.

A preferred staylog 10 according to one aspect of the present invention includes a cast cylinder 12 that defines end portions 14, 15 and a central portion 16 extending therebetween. As shown in FIGS. 1–2, a flitch 13 is mounted to the staylog 10 between the end portions 14, 15 and includes a mounting surface 17 and an outer veneer-producing surface 19.

The central portion 16 of the staylog 10 is milled to include a flat mounting surface 18 formed by a pair of mounting rails 16*a* and 16*b* defining an axial channel 20 therebetween extending along the longitudinal axis 11 of the cylinder 12. A pusher bar 22 is slidably disposed in the channel 20 and extends substantially along the length of the channel 20, the pusher bar 22 being several inches shorter than the channel 20 in order to allow for axial movement of the pusher bar 22 in the channel 20. The pusher bar 22 is sized to extend upwardly in the channel 20 so that the top surface 24 of the pusher bar 22 is substantially coplanar with, and forms part of, the mounting surface 18.

Figure 3:
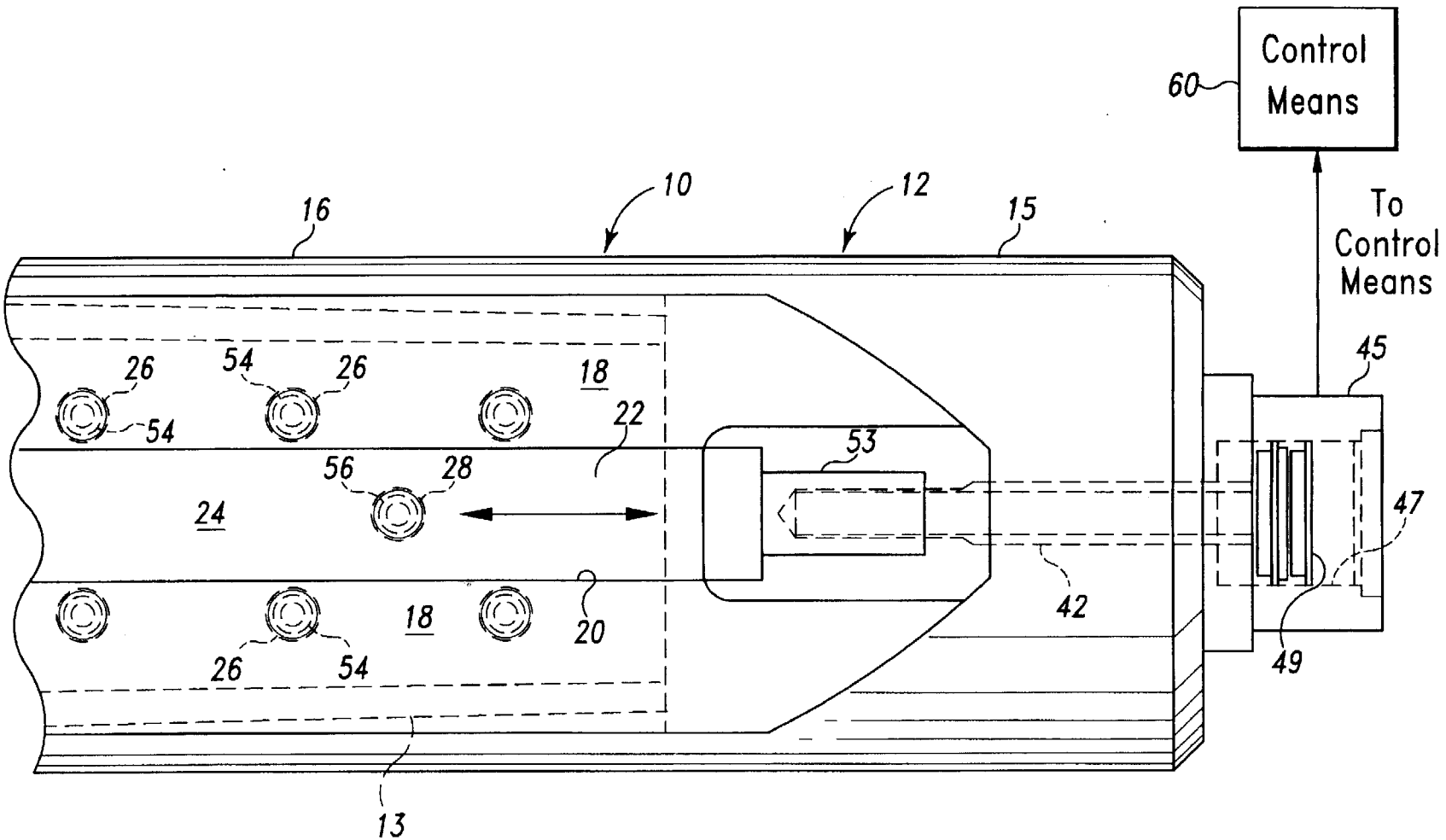
FIG. 3 is an enlarged top plan view of one end of the staylog and flitch of FIG. 1.
Figure 6:
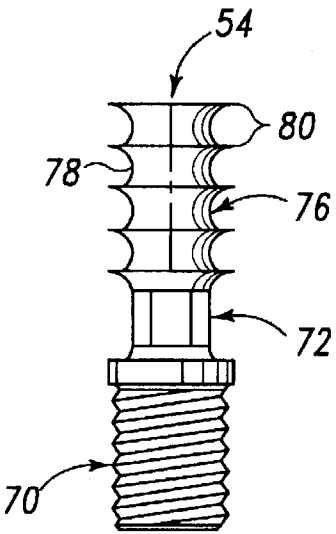
FIG. 6 is a side view of a stationary pin dog according to the present invention.

The mounting surface 18 includes a plurality of threaded pin dog apertures 26. The threaded apertures 26 are arranged in pairs along the length of the central portion 16, with the apertures of each pair disposed on opposite sides of the channel 20, as shown in FIGS. 1 and 3. A pin dog 54, shown more clearly in FIG. 6, is threaded into each pin dog aperture 26 to provide a plurality of stationary pin dogs extending orthogonally from the mounting surface 18.

Figure 5:
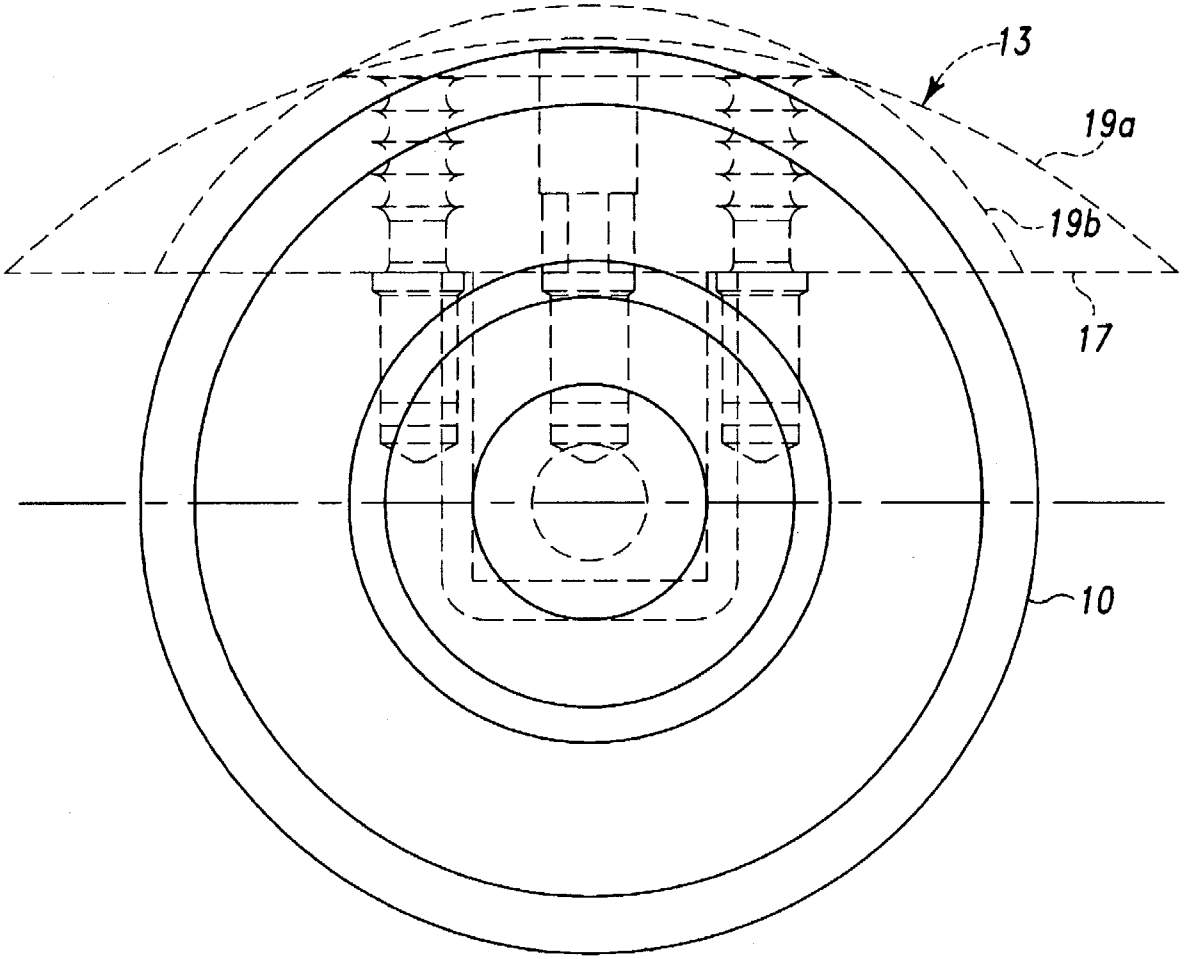
FIG. 5 is an enlarged end view of the staylog of FIG. 1.
Figure 7:
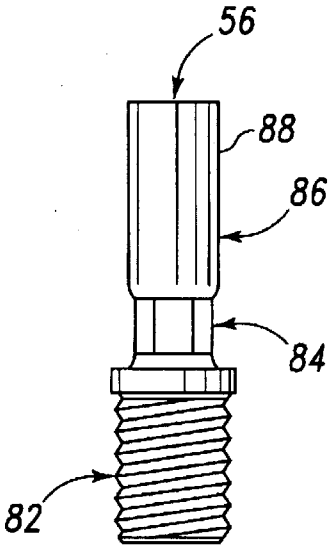
FIG. 7 is a side view of a pusher pin according to the present invention.
Figure 8:
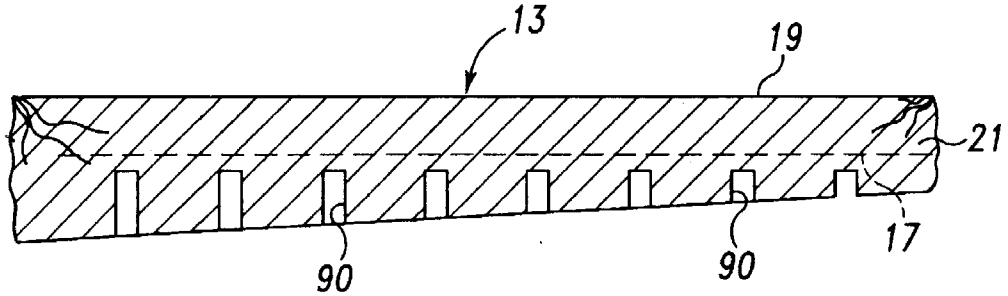
FIG. 8 is a sectional view of a flitch taken along lines 8—8 in FIG. 9.
Figure 9:
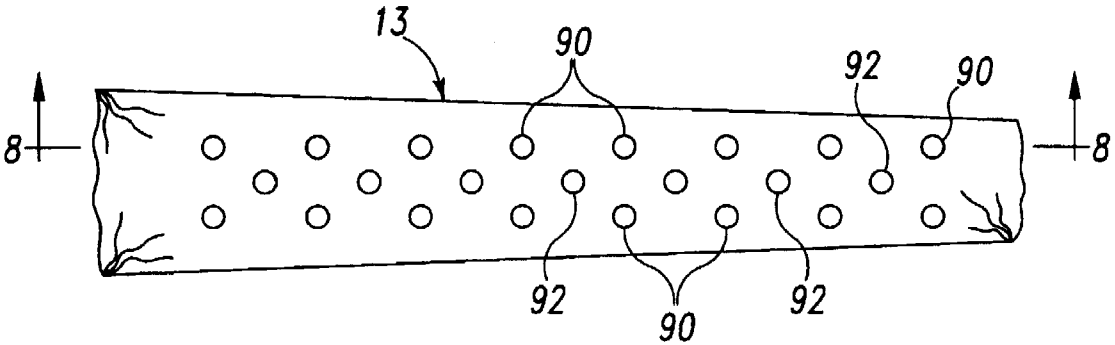
FIG. 9 is a bottom view of a flitch showing pin dog receiving apertures and pusher pin receiving apertures.

The top surface 24 of the pusher bar 22 includes a plurality of threaded pusher pin apertures 28 arranged in spaced-apart relation along the length of the pusher bar 22. A pusher pin 56, shown more clearly in FIG. 7, is threaded into each pusher pin aperture 28. A preferred arrangement of pin dogs 54 and pusher pins 56 is shown in FIGS. 1, 3 and 5 but other arrangements can be used without departing from the scope of the invention.

The end portions 14, 15 of the staylog 10 are essentially mirror images of each other, and include a central bore 42 that extends coaxially along the longitudinal axis 11 of the cylinder 12 and opens into the central channel 20. Piston housings 44, 45 are attached to the end portions 14, 15, respectively, and form cylinders 46, 47 which enclose drive pistons 48, 49, respectively. The pistons 48, 49 are positioned for movement along the axis 11. Pusher blocks 53*a*, 53*b* are disposed in the central bore 42 adjacent each end of the pusher bar 22. Piston rods 50, 51 are attached to the pistons 48, 49, respectively, and extend into the bore 42 to abut the pusher blocks 53*a*, 53*b*, respectively.

The pistons 48, 49 are controlled in a conventional manner by control means 60 which directs the flow of operating fluid from a reservoir (not shown) to one of the pistons 48, 49 and simultaneously permits a return flow of operating fluid from the other piston 49, 48 to the reservoir. Thus, application of operating fluid to piston 48 extends the piston rod 50 to drive the pusher block 53*a* and pusher bar 22 to the right. At the same time, operating fluid is vented from piston 49 back to the reservoir to prevent piston 49 from blocking movement of the pusher bar 22 to the right. Application of operating fluid to piston 49 extends the piston rod 51 to drive the pusher block 53*b* and pusher bar 22 to the left. At the same time, operating fluid is vented from piston 48 back to the reservoir to prevent piston 48 from blocking movement of the pusher bar 22 to the left. It will be appreciated that a single piston and piston rod can be attached directly to the pusher bar 22 to move the pusher bar 22 in both directions. In that case, the operating fluid would be directed to opposite sides of the piston.

The control means 60 includes control valves and actuating means connected as necessary to direct the operating fluid to the pistons 48, 49 and return the fluid to the reservoir. Operator input means 62 controls the flow of operating fluid by directing the control means 60 to direct operating fluid to piston 48 to drive the pusher bar 22 to the right or direct operating fluid to piston 49 to drive the pusher bar 22 to the left. Operator input means 62 can include actuating levers, pushbuttons or the like to indicate a desired direction of pusher bar movement.

As shown in FIG. 6, preferred pin dogs 54 include a lower threaded portion 70, a central polygon-shaped portion 72, and an upper flitch-engaging portion 76. The lower threaded portion 70 includes external threads for threadedly engaging the pin dog apertures 26. When used in conjunction with shims or washers, the lower threaded portion 70 also provides means for adjusting the orthogonal extension of the pin dogs relative to the mounting surface 18. The central polygon-shaped portion 72 is preferably hexagonal for engaging a wrench (not shown) for screwing the pin dog 54 into the pin dog aperture 26. The upper flitch-engaging portion 76 includes a scalloped side wall 78 defining a plurality of annular knife edges 80 for engaging a flitch 13. The annular knife edges 80 are axially spaced along the pin dogs 54 so as to be positioned at various distances from the staylog 10.

Preferred pusher pins 56 include a lower threaded portion 82, a central polygon-shaped portion 84, and an upper flitch-engaging portion 86. The lower threaded portion 82 and the central polygon-shaped portion 84 are substantially similar in design and identical in function to their counterparts 70, 72, respectively, on the pin dogs 54. The upper portion 86 includes a cylindrical side wall 88 for moving the flitch 13.

A flitch includes, generally, a conical portion corresponding to the base of the tree from which it was taken, and veneer taken from this portion of the flitch is frequently of the highest quality. As the flitch is normally mounted to the staylog, its outer surface and veneer-producing zone are not parallel to the slicing knife so that upon rotation of the staylog, only narrow waste sliced veneer is produced from the thicker end of the flitch. In the invention, the veneer-producing zone, which is generally a cylindrical segment, most generally a semi-cylindrical portion, is arranged with its axis of rotation parallel to the axis of rotation of the staylog.

Figure 4:
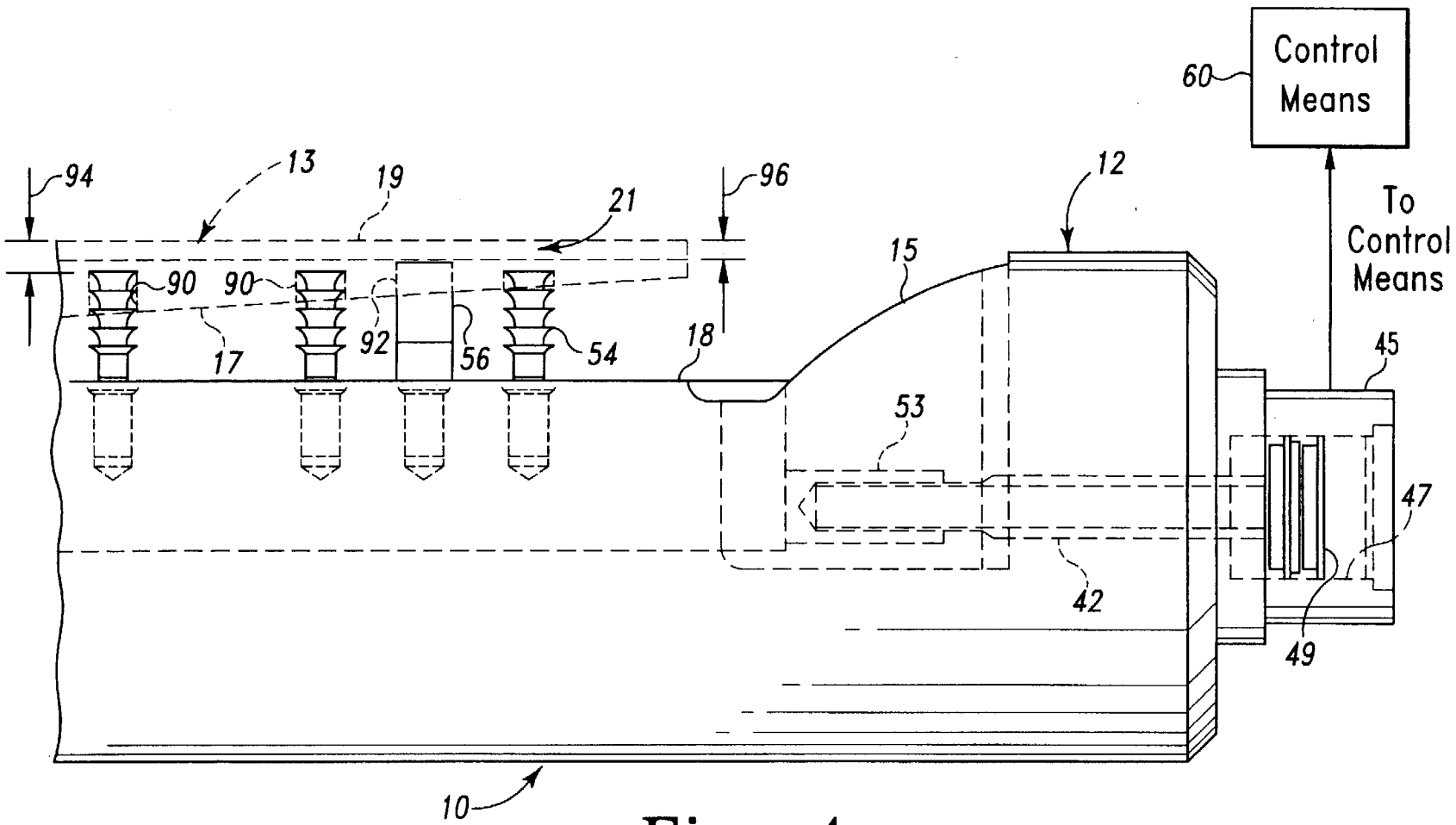
FIG. 4 is an enlarged side elevation of the end of the staylog and flitch of FIG. 1.

For example, the flitch 13 can be prepared for slicing by boring holes in the mounting surface 17 for receiving the pin dogs 54 and the pusher pins 56. As shown in FIG. 4, a first plurality of pin dog-receiving holes 90 are sized to fit and positioned to engage the pin dogs 54, and a second plurality of pusher pin-receiving holes 92 are sized to fit and positioned to engage the pusher pins 56. The pin dog-receiving holes 90 are formed to extend a predetermined distance from the mounting surface 18 of the staylog 10 into the flitch 13 so that all of the holes 90 terminate at a first distance 94 from the veneer-producing surface 19, thereby forming a veneer-producing zone 21, best illustrated in FIG. 4. Likewise, the pusher pin-receiving holes 92 terminate at a second distance 96 from the veneer-producing surface 19, wherein the first distance 94 can be equal to the second distance 96. The primary factors in determining the first and second distances 94, 96 is maximizing the depth of the veneer-producing zone 21 while affording maximum surface contact between the pusher pins 56 and the pusher pin-receiving holes 92 as well as maximum engaging contact between the pin dogs 54 and the flitch 13.

The flitch 13 is positioned on the staylog 10 with the pin dogs 54 and pusher pins 56 disposed in their respective holes. When positioning the flitch 13 on the staylog 10, the flitch 13 is aligned so that the veneer-producing zone 21 is parallel to the mounting surface 18 of the staylog 10, as shown in FIGS. 2 and 4. Due to the natural taper of the flitch 13, the mounting surface 17 of the flitch 13 will be positioned at an angle to the mounting surface 18 of the staylog 10. Consequently, the holes 90, 92 will have different depths in order to provide a constant-thickness veneer-producing zone 21.

Advantageously, the plurality of annular knife edges 80 on each pin dog 54 allows each pin dog 54 to engage the flitch 13 without regard to the distance between the mounting surface 17 of the flitch 13 and the mounting surface 18 of the staylog 10. Moreover, as shown in FIGS. 2 and 4, in those areas where the flitch 13 is thicker, and therefore more massive, more annular knife edges 80 engage the flitch 13 to provide additional holding capability where needed.

Once the flitch 13 is positioned on the staylog, the operator commands the pusher bar 22 to move in a first direction. The movement of the pusher bar 22 causes the pusher pins 56 to move the flitch 13 in the first direction until the flitch 13 engages the annular knife edges 80 on the pin dogs 54. The annular knife edges 80 cut into the flitch 13 and hold the flitch 13 in position. When the operator is satisfied that the flitch 13 is securely retained on the staylog, the operator adjusts the staylog offset to produce the desired curvature of the veneer-producing surface 19. Staylog offset is the distance between the axis of rotation of the staylog/flitch combination and the longitudinal axis 11 of the staylog 10. As shown in FIG. 5, the curvature can vary between curvatures 19*a* and 19*b*, depending on the staylog offset selected by the operator. With maximum offset, the resulting curvature is indicated at 19*a*. With minimum offset, the resulting curvature is indicated at 19*b*. Once the offset has been adjusted, the operator rotates the staylog and slices veneer from the flitch. When the veneer has been sliced from the flitch 13, the operator commands the pusher bar 22 to move in a second direction opposite to the first direction. The movement of the pusher bar 22 causes the pusher pins 56 to move the flitch 13 in the second direction until the flitch 13 disengages from the annular knife edges 80. Once the flitch 13 is disengaged from the pin dogs 54, it can be removed and replaced with another flitch 13.

If, because of the forces imposed on the flitch as it is sliced, the engagement between the flitch engaging surfaces and the pin dogs 54 and the engagement surfaces of the pin dog-receiving holes 90 becomes too loose, the operator can command the pusher bar 22 to move in a second direction opposite to the first direction. The movement of the pusher bar 22 causes the pusher pins 56 to move the flitch 13 in the second direction until the pin dogs 54 engage the flitch at different engagement surfaces of the pin dog-receiving holes 90 for completion of the slicing operation. When the slicing operation has been completed, the pusher bar 22 can be positioned so flitch 13 disengages from the annular knife edges 80. Once the flitch 13 is disengaged from the pin dogs 54, it can be removed and replaced with another flitch 13.

It will be appreciated that the knife edges can be modified to include non-annular knife edges without departing from the scope of the invention. For example, diametrally opposed knife edges could be aligned with the axial movement of the flitch 13 so as to engage the flitch 13 regardless of whether the flitch 13 moves to the right or left. However, annular knife edges are preferred because they provide more flitch engaging blade area.

The pusher pins 56 do not include knife edges in order to avoid pusher pin engagement with the flitch 13 while disengaging the flitch 13 from the pin dogs 56. If the pusher pins 56 included knife edges, the flitch 13 could remain engaged with the pusher pins, thereby preventing the easy removal of the flitch 13 from the staylog 10.

It will be appreciated that the pin dogs 54 could also be mounted on a conventional staylog and the flitch retained by pushing a movable pin dog toward a stationary pin dog and pinching the flitch 13 therebetween in a conventional fashion. Modifying a conventional staylog to include stationary and movable pin dogs 54 would eliminate the need for pusher pins 56 and pusher pin-receiving holes 92, thereby simplifying flitch preparation while still allowing for multiple knife edges 80 to engage the flitch 13 at various distances from the staylog mounting surface 18.

The preceding description related to dogs 54, 56 used with a non-conventional staylog 10. However, it would be clear to one of ordinary skill in the art that a conventional staylog could be modified to incorporate the present invention without departing from the scope of the invention. For example, FIGS. 8–11 illustrate alternative embodiments of the invention that can be incorporated into a conventional staylog.

Figure 10A:
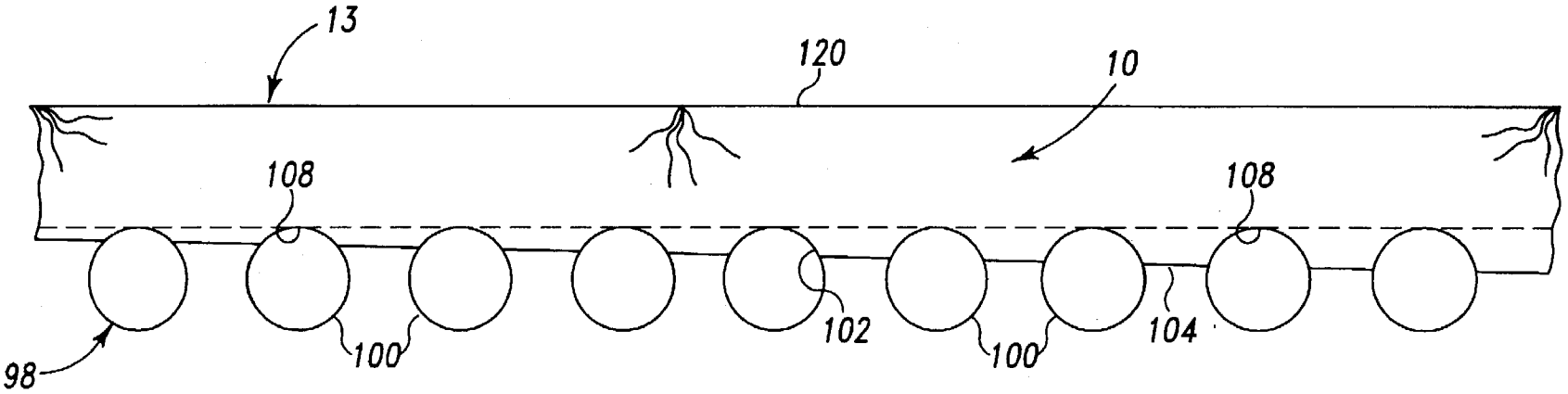
FIGS. 10*a*–10*b* show illustrative positions and depths of plunge cuts made by a dado saw.
Figure 10B:
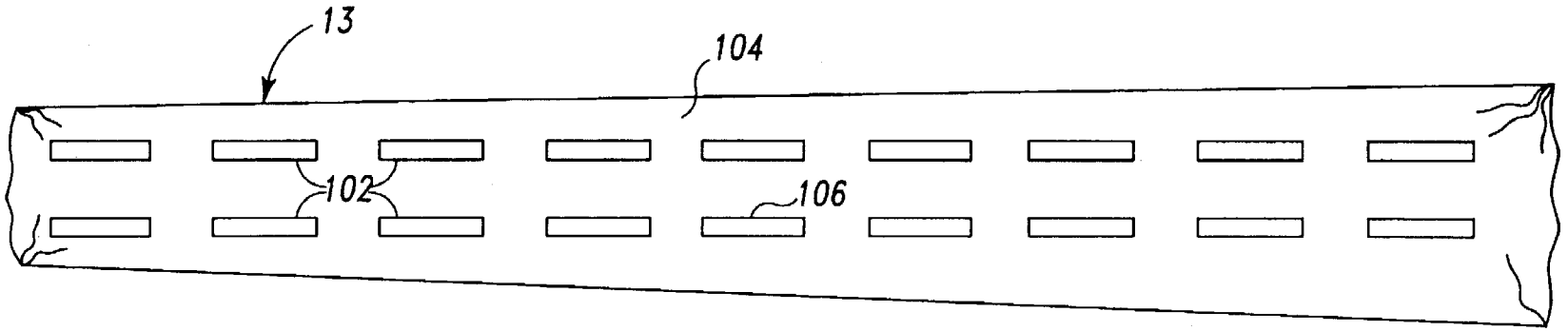

As generally indicated in FIGS. 10*a*–10*b*, hole forming means 98, illustratively a dado saw blade 100, can be used to cut dado holes 102 into the flitch mounting surface 104. The dado holes 102 have a generally rectangular opening 106 at the flitch mounting surface 104 (FIG. 10*b*) and a generally circular depth profile 108 (FIG. 10*a*). Dado holes 102 can be formed efficiently by moving a dado saw blade 100 along the flitch mounting surface 104 and plunging the saw blade 100 into the flitch at the desired positions to a desired depth, which would be determined by the thickness of the veneer-producing zone 105. Of course, the dado holes 102 can be formed by using other hole forming means, such as a router, drill, lasers, or the like. It is also possible to vary the shape of the dado holes 102 without departing from the scope of the invention. For example, the hole forming means 98 can be used to bore generally rectangular holes having a flat, rather than circular, depth profile.

Figure 11B:
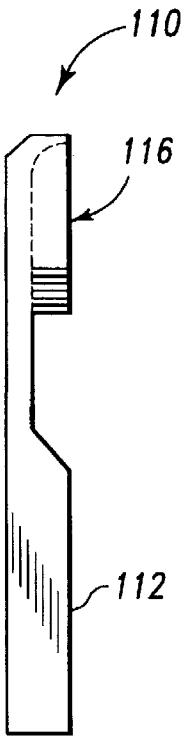
FIGS. 11*a*–11*b* show a dog configured to match a plunge cut of FIGS. 10*a*–10*b;*
Figure 11A:
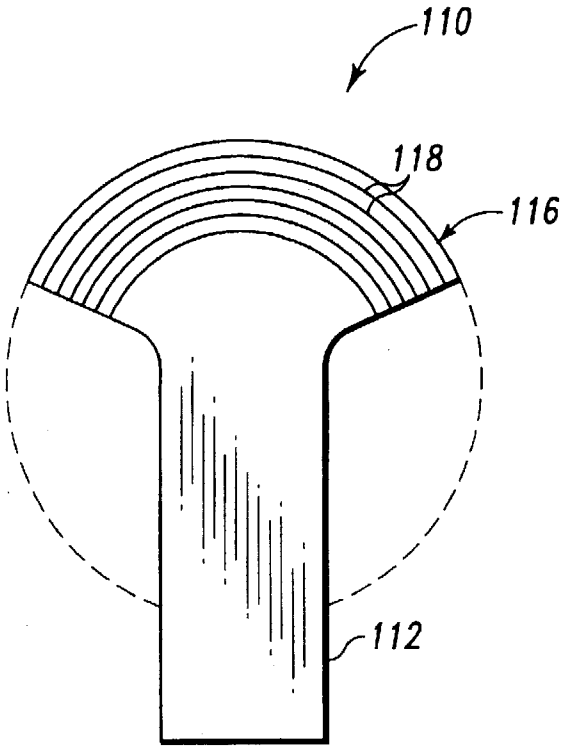
Figure 13B:
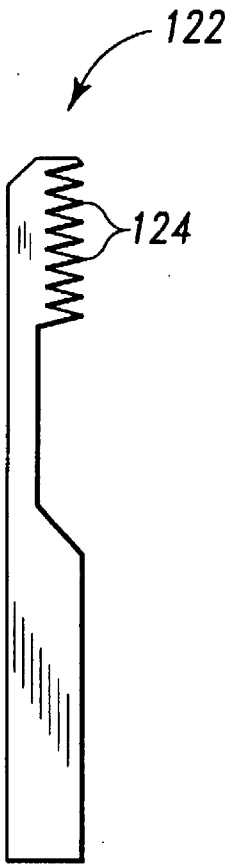
FIGS. 13*a*–13*b* show an alternative embodiment of the dog of FIGS. 11*a*–11*b;*
Figure 13A:
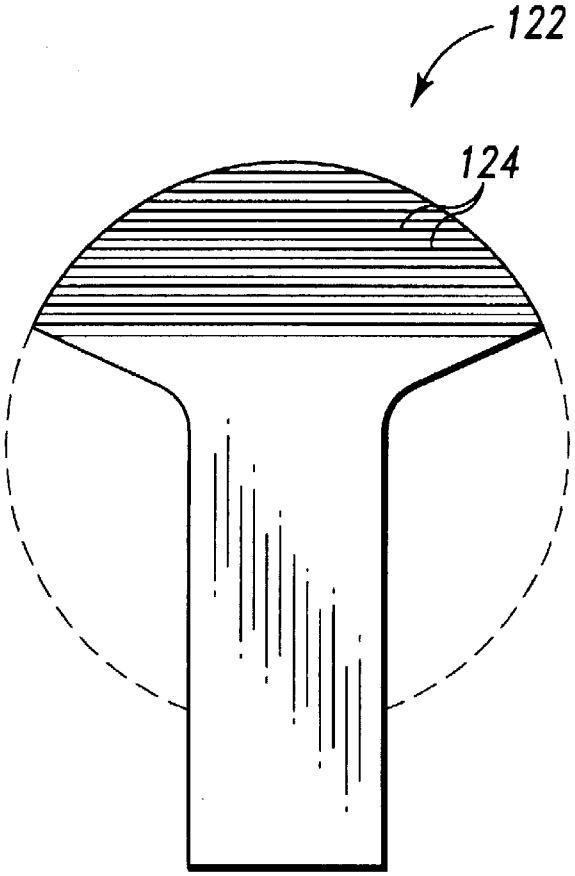

A flitch-retaining dog 110 for use with the dado holes 102 is illustrated in FIGS. 11*a*–11*b*. The dogs 110 include an elongated actuating arm 112 and a flitch-engaging portion 116 extending from the actuating arm 112. The flitch-engaging portion 116 is configured to conform to the depth profile 108 of the dado holes 102 and includes a plurality of circular flitch-engaging knife edges 118 configured to run parallel to the depth profile 108 of the dado hole 102. In an alternative embodiment, dogs 122 include straight knife edges 124, as shown in FIGS. 13*a*–13*b*, configured to run parallel to the veneer-producing surface 120 of the flitch. Of course, if the selected dado holes 102 include a flat depth profile, the dogs can include a rectangular flitch-engaging portion to conform to the flat depth profile.

Figure 12:
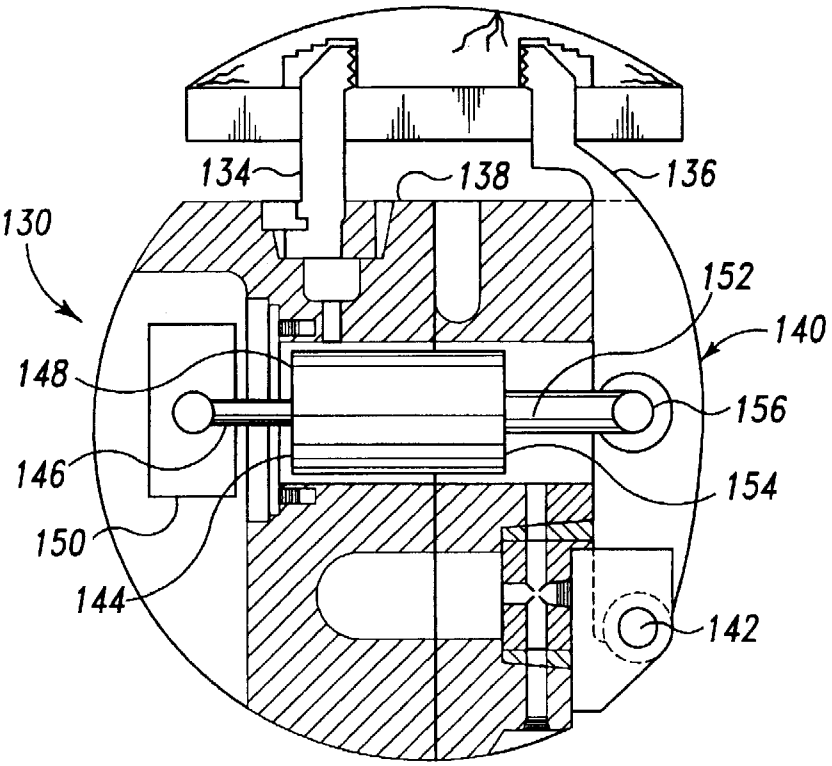
FIG. 12 illustrates the dogs of FIGS. 11*a*–11*b* installed on a conventional staylog.

Dogs 110, 122 can be coupled to a conventional staylog 130, as illustratively shown in FIG. 12. The dogs 110, 122 are mounted to the staylog 130 to form stationary dogs 134 and movable dogs 136 which are movable toward and away from the stationary dogs 150 to move the flitch 13 into engagement with the stationary dogs 134. The stationary dogs 134 extend from the staylog mounting surface 138 and the movable dogs 136 are coupled to one end of a pivotable lever arm 140. The lever arm 140 pivots about pivot pin 142 in response to actuation of a conventional hydraulic (or pneumatic) piston-cylinder 144.

The piston-cylinder 144 can be a self-contained unit installed in the staylog 130, as illustrated in FIG. 12. The piston-cylinder 144 includes a connecting rod 146 coupled to a trunion block 150 fitted into the staylog 130 and a first end 148 of the cylinder 144. A piston rod 152 extends from a second end 154 of the cylinder 144 to a connecting pin 156 formed in the lever arm 140.

The narrowest portion of the flitch 13 would be positioned farthest from the staylog mounting surface 104, due to the taper of the log, as previously described with reference to the embodiments of FIGS. 1–7.

An important feature of the present invention is the use of individual holes bored into the flitch mounting surface to accept flitch-retaining dogs, with the holes being separated from each other by areas of solid wood. It is the areas of solid wood between the holes that strengthen the edges of the flitch to eliminate flexing of the flitch edge under pressure from the knife. Eliminating flexing at the flitch edge allows a slicer to remove more of the best veneer from the edges without the problem of nonuniform and unacceptable veneer that arises in conventional flitch-retaining methods and apparatus.

Figure 14:
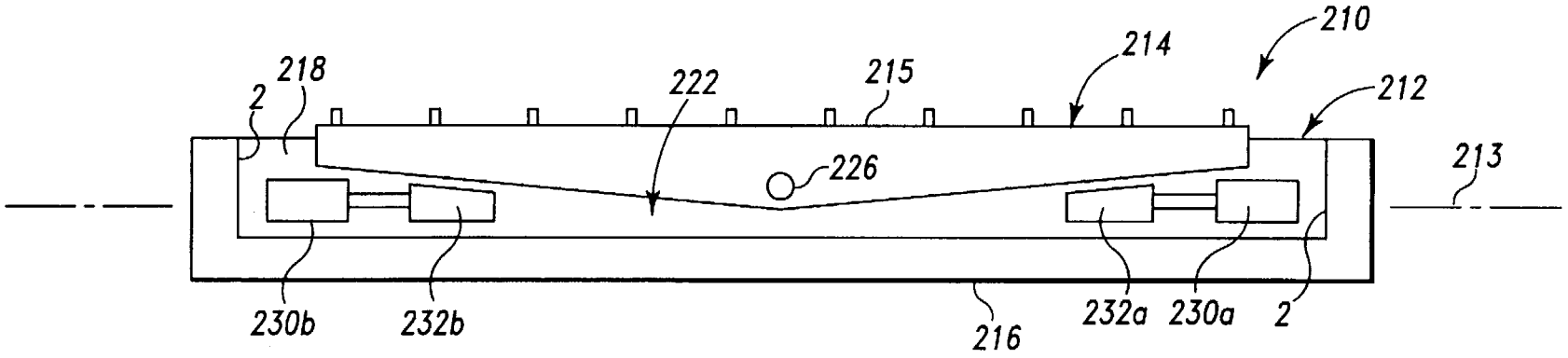
FIG. 14 is a schematic diagram of a staylog including a mounting surface pivotally mounted to the body of the staylog.

In another alternative embodiment of the invention, as shown in FIG. 14, stationary and movable dogs operate in a fashion as previously described to retain the flitch on the staylog. However, the flitch mounting surface is positioned adjacent the staylog mounting surface and the staylog mounting surface is pivoted about a pivot pin to reorient the flitch relative to the veneer-slicing knife. Pivoting the mounting surface allows the staylog to accommodate the taper of the flitch and retain the veneer-producing zone generally parallel to the knife.

In the embodiment of FIG. 14, a staylog 210 includes a staylog body 212 having an axis of rotation 213 and a pivotable mounting member 214 having a mounting surface 215 for receiving a flitch. The body 212 includes a base wall 216, a pair of side walls 218 and a pair of end walls 220. The base wall 216, side walls 218 and the end walls 220 cooperate to define a longitudinally extending channel 222. A pivot pin 226 extends across the channel 222 between the side walls 218. The pivotable mounting member 214 generally fits within the channel 222 and pivots about the pivot pin 226 to align the plane of the mounting surface 215 at an angle to the axis of rotation 213 of the staylog 210.

A pair of actuators 230*a*, 230*b* are disposed in the channel 222 and are coupled to reorienting means 232*a*, 232*b*. The reorienting means 232*a*, 232*b* includes rollers or wedges or the like that are movable along the longitudinal axis of the channel 222 between the pivotable member 214 and the base wall 216. The actuators 230*a*, 230*b* are coupled to a conventional controller (not shown) to control the movement of the reorienting means 232*a*, 232*b*. For example, the controller can direct the actuators 230*a*, 230*b* to move reorienting means 232*a*, 232*b*, respectively, to the left, thereby lifting the right side of the mounting surface 215 while lowering the left side. Thus, movement of the reorienting means 232*a*, 232*b* reorients the plane of the mounting surface 215 relative to the longitudinal axis 213 of the staylog 210.

In operation, the flitch is mounted on the pivotable member 214 and the staylog 210 rotated to set the flitch next to the veneer-slicing knife. An operator commands the controller to direct the actuators 230*a*, 230*b* to move the reorienting means 232*a*, 232*b* so as to align the outside surface of the flitch with the knife. When the outside surface of the flitch is parallel to the knife, the staylog is rotated to move the flitch past the veneer-slicing knife. When the outside surface of the flitch is parallel to the knife, the veneer-producing zone is substantially parallel to the knife and the slicer is configured to minimize the amount of waste veneer taken from the outside, or veneer-producing zone, of a flitch.

It will be apparent to one of ordinary skill in the art that the above-described device can be modified without departing from the scope of the invention. For example, the pivotable member 214 can be pivoted at an end rather than in the middle as illustrated in FIG. 14. The pivotable member 214 can be biased so that a single reorienting means operates against the biasing to lift one end of the pivotable member 214 or cooperates with the biasing to lower the end of the pivotable member 214.

In yet another alternative embodiment of the invention, stationary and movable dogs retain the flitch on the staylog. However, the ends of the staylog are offset from the axis of rotation of the staylog so as to maintain the veneer-producing zone parallel to the knife. In being offset, one end of the staylog can be offset from the axis of rotation by a greater distance than the other, or the ends can be equally offset. The offset permits the thicker end of a tapered flitch to be retained at the same distance from the knife as the thinner end.

Figure 15:
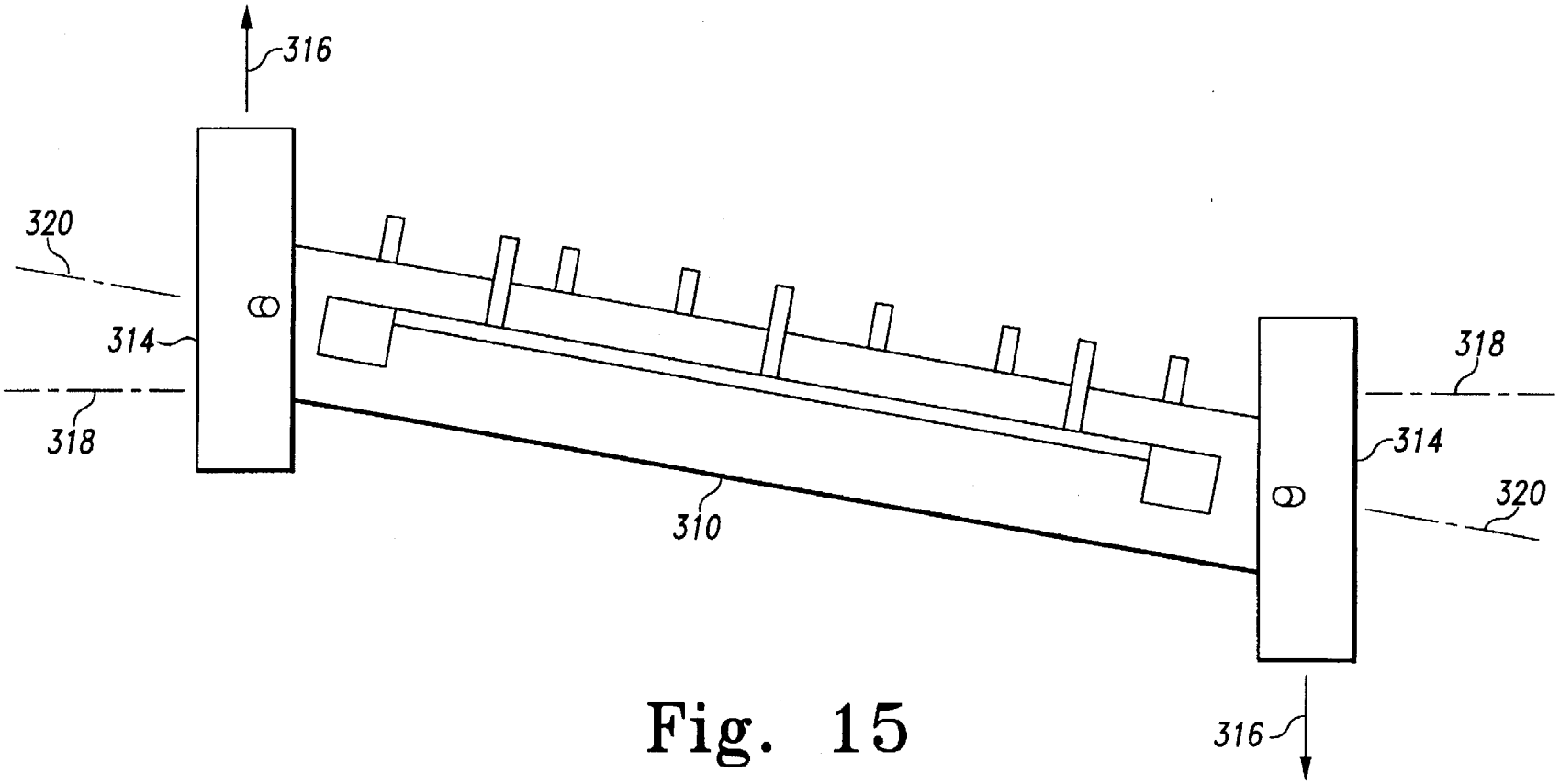
FIG. 15 is a schematic diagram of a staylog that is movable to reorient the longitudinal axis of the staylog at an angle to the axis of rotation of the staylog.

For example, as illustrated in FIG. 15, a staylog 310 includes a staylog body 312 and a pair of end supports 314. The end supports 314 are configured to move perpendicularly 316 to the axis of rotation 318 of the staylog 310 so as to reorient the longitudinal axis 320 of the staylog 310 relative to the axis of rotation 318 of the staylog 310.

Although the invention has been described in detail with reference to a certain preferred embodiment, variations and modifications exist within the scope and spirit of the invention as described and defined in the following claims.

I claim:

1. A method for cutting veneer from a tapered flitch so as to minimize the amount of waste veneer cut from a veneer-producing zone extending inwardly from the periphery of the flitch, the method comprising the steps of:

positioning the tapered flitch in a veneer-slicing position on a rotating staylog, the veneer-slicing position being defined so that the veneer-producing zone is generally semi-cylindrical with its central axis generally parallel to a veneer-slicing knife; and rotating the staylog and moving the flitch into engagement with the veneer-slicing knife.

2. The method of claim 1 further comprising the step of forming a plurality of pin dog receiving apertures in a mounting surface of the flitch.

3. A method for cutting veneer from a tapered flitch so as to minimize the amount of waste veneer cut from a veneer-producing zone extending inwardly from the periphery of the flitch, the method comprising the steps of:

forming a plurality of pin dog receiving apertures in a mounting surface of the flitch;

forming a plurality of pusher pin receiving apertures in the mounting surface of the flitch;

positioning the tapered flitch in a veneer-slicing position on a plurality of pin dogs on a rotating staylog, the veneer-slicing position being defined so that the veneer-producing zone is generally semi-cylindrical with its central axis generally parallel to a veneer-slicing knife; and rotating the staylog and moving the flitch into engagement with the veneer-slicing knife.

4. The method of claim 3 wherein the plurality of pusher pin receiving apertures cooperates with the plurality of pin dog receiving apertures to define a lower boundary of the veneer-producing zone.

5. The method of claim 3 further comprising the step of coupling a plurality of pin dogs and a plurality of pusher pins to the staylog and inserting the pin dogs and pusher pins into the plurality of pin dog receiving apertures and the plurality of pusher pin receiving apertures, respectively, and moving the pusher pins relative to the pin dogs to move the flitch into engagement with the pin dogs to retain the flitch on the staylog.

6. A method for cutting veneer from a tapered flitch so as to minimize the amount of waste veneer cut from a veneer-producing zone extending inwardly from the periphery of the flitch, the method comprising the steps of:

positioning the tapered flitch in a veneer-slicing position on a rotating staylog, the veneer-slicing position being defined so that the veneer-producing zone is generally semi-cylindrical with its central axis generally parallel to a veneer-slicing knife, wherein the positioning step includes the step of coupling a plurality of dogs to the staylog to define the generally semi-circular veneer-producing zone; and rotating the staylog and moving the flitch into engagement with the veneer-slicing knife.

7. The method of claim 6 wherein the dogs are pin dogs, and the staylog is provided with means to push the flitch into engagement with the pin dogs to retain the flitch on the staylog.

8. The method of claim 7 wherein each pin dog includes a plurality of knife edges for engaging the flitch, the knife edges being positioned axially along the pin dog to engage the flitch at different distances from the staylog.

9. The method of claim 1 wherein the flitch includes a mounting surface and the staylog includes a mounting surface and the positioning step includes the steps of mounting the flitch mounting surface against the staylog mounting surface and orienting the staylog mounting surface at an angle to the axis of rotation of the staylog.

10. The method of claim 1 wherein the flitch includes a mounting surface and the staylog includes a mounting surface and the positioning step includes the steps of mounting the flitch mounting surface against the staylog mounting surface and orienting the staylog so that the longitudinal axis of the staylog is at an acute angle to the axis of rotation of the staylog.

11. An apparatus for retaining a tapered flitch having a mounting surface and a veneer-producing zone for slicing veneer from its veneer-producing zone, the apparatus comprising:

a staylog having a mounting surface, means for retaining the flitch on the staylog and positioning the veneer-producing zone with its outer periphery substantially parallel to a veneer-slicing knife for substantially the entire length of its outer periphery.

12. The apparatus of claim 11 wherein the retaining and positioning means includes a plurality of dogs extending from the staylog mounting surface, said plurality of dogs providing a plurality of engaging surfaces for engaging the flitch at different distances from the staylog mounting surface.

13. The apparatus of claim 12 wherein the flitch is retained on the staylog by the plurality of dogs so as to orient the flitch mounting surface in a non-parallel relation with the staylog mounting surface.

14. The apparatus of claim 12 wherein the flitch is retained on the staylog by the plurality of dogs with the flitch mounting surface disposed adjacent the staylog mounting surface, the staylog including means for positioning the outer periphery of the veneer-producing zone parallel to the veneer-slicing knife.

15. The apparatus of claim 11 further including means for rotating the staylog about an axis of rotation wherein the means for positioning includes means for offsetting the longitudinal axis of the staylog from the axis of rotation of the staylog.

16. The apparatus of claim 11 further including means for rotating the staylog about an axis of rotation wherein the means for positioning includes means for setting the plane of the staylog mounting surface at an acute angle to the axis of rotation of the staylog.

17. An apparatus for slicing veneer from a tapered flitch having a mounting surface and an axis of rotation providing a generally semi-cylindrical veneer-producing zone, the apparatus comprising:

a staylog having a staylog mounting surface;

a plurality of dogs for engaging the flitch when the flitch mounting surface is disposed in a non-parallel relation to the staylog mounting surface and the axis of rotation of the veneer-producing zone is disposed generally parallel to a staylog mounting surface, and means for coupling the plurality of dogs to the flitch to retain the flitch mounting surface in the non-parallel relation with the staylog mounting surface.

18. The apparatus of claim 17 wherein the plurality of dogs extend orthogonally from the mounting surface of the staylog and each dog includes a plurality of axially spaced knife edges.

19. The apparatus of claim 18 wherein each knife edge is positioned at a predetermined distance from the mounting surface to allow each dog to engage the flitch at a plurality of locations distal from the staylog mounting surface.

20. An apparatus for slicing veneer from a tapered flitch having a mounting surface and an axis of rotation providing a generally semi-cylindrical veneer-producing zone, the apparatus comprising:

a staylog having a staylog mounting surface;

a plurality of dogs for engaging the flitch when the flitch mounting surface is disposed in a non-parallel relation to the staylog mounting surface and the axis of rotation of the veneer-producing zone is disposed generally parallel to a staylog mounting surface, and means for coupling the plurality of dogs to the flitch to retain the flitch mounting surface in the non-parallel relation with the staylog mounting surface;

said coupling means including a plurality of push pins movably coupled to the staylog and a hydraulic actuator coupled to the push pins for moving the push pins relative to the plurality of dogs.

21. The apparatus of claim 20 wherein the flitch includes a plurality of apertures for receiving the push pins.

22. An apparatus for slicing veneer from a flitch having a mounting side corresponding to the central portion of a tree and a veneer-producing side corresponding to the peripheral portion of the tree, the apparatus comprising:

a staylog for carrying the flitch, a knife for slicing veneer from the flitch, and means for mounting the flitch on the staylog to provide an axis of rotation of the veneer-producing side of the flitch that lies substantially parallel to the knife so as to minimize the amount of waste veneer cut from the peripheral portion of the tree.

23. The apparatus of claim 22 wherein the mounting means includes a plurality of pin dogs coupled to, and held stationary relative to, the staylog.

24. An apparatus for slicing veneer from a flitch having a mounting side corresponding to the central portion of a tree and a veneer-producing side corresponding to a peripheral portion of the tree, the apparatus comprising:

a staylog for carrying the flitch, a knife for slicing veneer from the flitch, and means for mounting the flitch on the staylog to provide an axis of rotation of the veneer-producing side of the flitch that lies substantially parallel to the knife so as to minimize the amount of waste veneer cut from the peripheral portion of the tree, wherein the mounting means includes a plurality of pin dogs coupled to, and held stationary relative to, the staylog, and the flitch includes a plurality of holes for receiving the plurality of pin dogs, each pin dog being at least partially disposed inside one of the plurality of holes.

25. The apparatus of claim 24 wherein each pin dog includes a plurality of annular knife edges, and at least one of the plurality of knife edges is positioned to engage the flitch.

26. The apparatus of claim 22 wherein the mounting means includes a pushing means movably coupled to the staylog and positioned to engage the flitch.

27. The apparatus of claim 26 wherein the mounting means further includes means for moving the pushing means relative to the plurality of pin dogs to move the flitch into engagement with the pin dogs.

28. The apparatus of claim 27 wherein the moving means includes a hydraulic piston coupled to the pushing means.

29. The apparatus of claim 22 wherein the staylog includes an axially extending channel and an axially movable pusher bar positioned in the channel and the mounting means includes a plurality of pusher pins coupled to the pusher bar and a plurality of stationary pin dogs coupled to the staylog.

30. A method of slicing veneer from a tapered flitch so as to minimize the amount of waste veneer taken from a veneer-producing zone, the method comprising the steps of:

preparing a tapered flitch to include a semi-cylindrical veneer-producing zone extending along the length of the flitch;

mounting the flitch to orient the semi-cylindrical veneer-producing zone parallel to a veneer-slicing knife; and rotating the semi-cylindrical veneer-producing zone past the veneer-slicing knife so as to slice veneer from the veneer-producing zone.

31. The method of claim 30 further including the step of retaining the flitch on a staylog so as to maintain the veneer-producing zone substantially parallel to the veneer slicing knife.

32. A method for cutting veneer from a tapered flitch comprising the steps of:

mounting a tapered flitch on a staylog in a veneer-slicing position with its outer periphery substantially parallel to a veneer-slicing knife to create a veneer-producing zone in the flitch lying parallel to a veneer-slicing knife, the veneer-producing zone including a semi-cylindrical zone extending radially inwardly from the periphery of the flitch; and rotating the staylog to move the flitch past the knife to slice veneer from the flitch.

33. A method for cutting veneer from a tapered flitch comprising the steps of:

mounting a tapered flitch on a mounting surface of a staylog; and moving the mounting surface of the staylog to position an outer veneer-producing surface of the flitch parallel to a veneer-slicing knife, and rotating the staylog.

34. A method for cutting veneer from a tapered flitch comprising the steps of:

mounting a tapered flitch on a mounting surface of a staylog; and moving the mounting surface of the staylog to position an outer veneer-producing surface of the flitch parallel to a veneer-slicing knife wherein the moving step includes the step of orienting the staylog to align the outer veneer-producing surface generally parallel to the veneer-slicing knife; and rotating the staylog.

35. A method for cutting veneer from a tapered flitch comprising the steps of:

mounting a tapered flitch on a mounting surface of a staylog; and moving the mounting surface of the staylog to position an outer veneer-producing surface of the flitch parallel to a veneer-slicing knife, wherein the staylog includes a body and a mounting surface and the moving step includes the step of reorienting the mounting surface relative to the body of the staylog by positioning reorienting means between the mounting surface and the body of the staylog; and rotating the staylog.

36. The method of claim 35 wherein the reorienting means includes at least one roller.

37. The method of claim 35 wherein the reorienting means includes at least one wedge.

38. The method of claim 1 further comprising providing the tapered flitch with a staylog mounting surface having a plurality of dog-receiving apertures, positioning the tapered flitch on the staylog with the plurality of dogs in the plurality of dog-receiving apertures, and engaging the plurality of dogs and the flitch to retain the flitch in position for cutting.

* * * * *